United States Patent [19]

Hattori et al.

[11] Patent Number: 4,873,709

[45] Date of Patent: Oct. 10, 1989

[54] X-RAY GENERATOR WITH GROOVED ROTARY ANODE

[75] Inventors: Shuzo Hattori, 42-1, Oaza Nagakute Aza Musashizuka, Nagakute-cho, Aichi-gun, Aichi-ken; Takashi Tagawa, Nara; Motomu Asano, Nagoya, all of Japan

[73] Assignees: Meitec Corporation, Nagoya; Shuzo Hattori, Aichi, both of Japan

[21] Appl. No.: 220,087

[22] Filed: Jul. 18, 1988

[30] Foreign Application Priority Data

Jul. 24, 1987 [JP] Japan ..... 62-186115
Jul. 24, 1987 [JP] Japan ..... 62-186116

[51] Int. Cl.[4] ..... H01J 35/10

[52] U.S. Cl. ..... 378/142; 378/123; 378/127; 378/199

[58] Field of Search ..... 378/142, 141, 127, 130, 378/199, 200, 144, 123

[56] References Cited

U.S. PATENT DOCUMENTS

| | | | |
|---|---|---|---|
| H000,312 | 7/1987 | Parker | 378/141 |
| 2,075,146 | 12/1934 | Sergeeff | 378/123 |
| 4,130,773 | 12/1978 | Küssel | 378/123 |
| 4,521,903 | 6/1985 | Braun | 378/141 |
| 4,688,239 | 8/1979 | Schaffner et al. | 378/142 |

FOREIGN PATENT DOCUMENTS 2724732 12/1978 Fed. Rep. of Germany ..... 378/130

*Primary Examiner*—Carolyn E. Fields
*Assistant Examiner*—Joseph A. Hynds
*Attorney, Agent, or Firm*—Dennison, Meserole, Pollack & Scheiner

[57] ABSTRACT

An X-ray generator includes a vacuum vessel; a cathode disposed in the vacuum vessel for emitting an electron beam; a plurality of stators constituting an electric motor and disposed within the vacuum vessel for generating rotating magnetic fields; a drum-shaped anode adapted to rotate upon reception of the rotating magnetic fields generated from the stators and radiate an X-ray upon reception of the electron beam emitted from the cathode, the drum-shaped anode having a circumferentially extending narrow groove formed at the position where the electron beam from the cathode is focused; a plurality of rotary fins mounted on the drum-shaped anode for dissipating the heat generated in the groove upon radiation of an X-ray; and a plurality of fixed fins mounted within the vacuum vessel in opposed relation to the rotary fins and adapted to receive the heat transferred from the rotary fins and dissipate the heat to the outside of the vacuum vessel.

3 Claims, 8 Drawing Sheets

X-RAY GENERATOR WITH GROOVED ROTARY ANODE

BACKGROUND OF THE INVENTION

1. Field of the Invention

The present invention relates to an X-ray generator such as for lithography to be used in exposure replicating such as of an internal pattern of a very large scale integrated circuit (VLSI), and more particularly to an X-ray generator including means for effectively dissipating the heat generated at an anode on radiation of X-rays.

2. Description of the Prior Art

Recently, great attention has been paid to X-ray lithography for use as exposure equipment in the process of exposure replicating such as of an internal pattern of a very large scale integrated circuit (VLSI). This is because, as the line width of the internal pattern fabrication of the VLSI is so thin as to be submicrons, the X-ray lithography is quite effective means for accurately forming such an internal pattern of the VLSI by the exposure replicating. X-rays also have medical application in addition to such exposure replicating of the internal pattern of the VLSI.

In order to achieve effective and stable generation of X-rays, excessive increase in temperature of the anode must be prevented. This is because high temperature at the anode causes thermal distortion, which results in unstable generation of X-rays. Therefore, in order to obtain intensive X-rays stably, the anode must be cooled so as to hold the local temperature difference in the anode below, for example, 500° C./mm.

An article entitled "X-ray Source Technology for Microlithography" described in Semiconductor International Vol. 6, No. 9 (published in September of 1983) pp. 74–77 reports that a rotary anode or a fixed anode can be used as an X-ray source, and the rotary anode is mainly for medical application, while the fixed anode is for X-ray lithography. As the intensity of X-rays for medical application is relatively low, the temperature of heat generated at the anode is low and can be sufficiently dissipated in the vacuum to prevent excessive increase in temperature at the anode.

The article further reports that, on the contrary, X-ray lithography, using relatively intensive X-rays which cause large heating value at the anode, employe not a rotary anode but a fixed anode which is cooled by water for heat sink.

The prior art rotary anode as described above is cooled by means which permits heat generated at the anode to be dissipated from the anode in rotation directly into the vacuum. Consequently, it has a limit in its heat-dissipating effect, so that generation of intensive X-rays will cause thermal distortion, which makes it very difficult to generate X-rays in a stable condition. In case of cooling by water the rotary member or the anode in the X-ray generator which is held in a high vacuum, it requires a complex and expensive sealing mechanism, which is also quite difficult to maintain. On the other hand, in case of the fixed anode, the sealing mechanism for water cooling is simple, but the overall size becomes large. Therefore, provision of an effective and simple X-ray generator has been long desired.

SUMMARY OF THE INVENTION

It is, accordingly, an object of the present invention to provide an X-ray generator wherein the heat of an anode may be effectively dissipated.

It is another object of the present invention to provide an X-ray generator which may enhance the effect of heat transfer from rotary fins to fixed fins.

In accordance with the present invention, there is provided an X-ray generator which comprises a vacuum vessel; a cathode disposed in the vacuum vessel for emitting an electon beam; a plurality of stators constituting an electric motor and disposed within the vacuum vessel for generating rotating magnetic fields; a drum-shaped anode adapted to rotate upon reception of the rotating magnetic fields generated from the stators and radiate an X-ray upon reception of the electron beam emitted from the cathode, the drum-shaped anode having a circumferentially extending narrow groove formed at the position where the electron beam from the cathode is focused; a plurality of rotary fins mounted on the drum-shaped anode for dissipating the heat generated in the groove upon radiation of an X-ray; and a plurality of fixed fins mounted within the vacuum vessel in opposed relation to the rotary fins and adapted to receive the heat transferred from the rotary fins and dissipate the heat to the outside of the vacuum vessel.

Also in accordance with the present invention, there is provided an X-ray generator which comprises a vacuum vessel; a cathode disposed in the vacuum vessel for emitting an electron beam; a plurality of stators constituting an electric motor and disposed within the vacuum vessel for generating rotating magnetic fields; a disk-shaped anode adapted to rotate upon reception of the rotating magnetic fields generated from the stators and radiate an X-ray upon reception of the electron beam emitted from the cathode, the disk-shaped anode having a narrow groove formed in the underside along the periphery thereof where the electron beam from the cathode is focused; a plurality of rotary fins mounted on the disk-shaped anode for dissipating the heat generated in the groove upon radiation of an X-ray; a plurality of fixed fins mounted within the vacuum vessel in opposed relation to the rotary fins and adapted to receive the heat transferred from the rotary fins and dissipate the heat to the outside of the vacuum vessel; first exhaust port means communicating with a first space defined between the cathode and the anode; second exhaust port means communicating with a second space defined between the rotary fins and the fixed fins; gas inlet port means for introducing gas into the second space at a predetermined flow rate; a first vacuum pump mounted on the first exhaust port means for producing a high vacuum in the first space; and a second vacuum pump mounted on said second exhaust port means for producing a soft vacuum in the second space in response to the flow rate of gas flown into the second space.

The advantage of the X-ray generator according to the first embodiment will be explained with reference to FIGS. 7 to 10.

As shown in FIG. 7, the X-ray generator has a rotary drum 102 of a cm in radius and serving as an anode 101. The rotary drum 102 has, for example, on the outer peripheral surface thereof a circumferentially extending V-shaped or U-shaped groove of d cm in width and h cm in depth, such as a groove 103 shown in FIG. 8. When an electron beam having a diameter of d cm and a power of P watt strikes against the groove 103 of the anode 101 rotating at a speed of vrps in the direction of an arrow, the temperature rise $\Delta\theta$ in the groove 103 is represented by the following equation:

$$\Delta\theta=0.23\times(K\times\rho\times Cp)^{\frac{1}{2}}\times(a\times v/d)^{\frac{1}{2}}\times(d/h)\times(P/d^2) \quad (1)$$

where K is the heat conductivity, Cp is the specific heat, and $\rho$ is the density of the anode material ($g/cm^3$).

When the rotary drum 102 is provided with rotary fins, the temperature difference $\theta f$ in the rotary fins caused by steady heat conduction by the rotary fins is represented by the following equation:

$$\theta f = (P/K) \times \int \frac{1}{S(\vec{r})}\, d\vec{r} \quad (2)$$

where $\vec{r}$ is the position vector in the direction of heat conduction, and $S(\vec{r})$ is the cross sectional area of the fin.

Radiation cooling of the heat averaged by the rotary drum 102 from the rotary fins to the fixed fins is represented by the following equation in accordance with Stefan-Boltzmann's radiation law:

$$P=\sigma s\times\{(\theta av+273)^4-(\theta c+273)^4\}\times S \quad (3)$$

where P is the radiant energy (watt), $\sigma s$ is Stefan-Boltzmann constant ($5.67\times10^{-8}$), $\theta av$ is the average temperature of the rotating part (°C.), $\theta c$ is the temperature of the fixed fins (temperature of the external cooling system) (°C.), and S is the surface area of the fins ($m^2$).

Consequently, the temperature $\theta$ of the X-ray generating portion of the grooved rotary anode is represented by the following equation:

$$\theta=\Delta\theta+\theta f+\theta av \quad (4)$$

In this connection, the temperature rise $\Delta\theta p$ of a plane and fixed anode 111, as shown in FIG. 9, is represented by the following equation:

$$\Delta\theta p=(4/\pi)\times K^{-1}\times th\times(P/d^2) \quad (5)$$

$$\Delta\theta p=\theta 1-\theta 0 \quad (6)$$

where K is the heat conductivity, th is the thickness of the anode 111 (cm), P is the power of the electron beam emitted from an external source (watt), d is the diameter of the electron beam (cm), $\theta 1$ is the heating temperature at the surface of the anode 111, and $\theta 0$ is the temperature at the depth th from the surface of the anode 111.

When a non-grooved rotary anode 112 of a cm in radius as shown in FIG. 10 is rotated at a speed of vrps, the temperature rise $\Delta\theta s$ on generation of X-ray is represented by the following equation:

$$\theta s=0.45\times(K\times\rho\times Cp)^{-\frac{1}{2}}\times(a\times vd)^{-\frac{1}{2}}\times(P/d^2) \quad (7)$$

where K is the heat conductivity, Cp is the specific heat, $\rho$ is the density of the anode material, P is the power of the electron beam, and d is the diameter of the electron beam, respective units being equal to those of Equation (1.).

When the temperature rises represented by Equations (1), (5) and (7) on generation of X-ray at the respective anodes are compared, it is found that the lowest temperature rise on generation of X-ray occurs in the grooved rotary anode formed of a rotary drum which has a circumferentially extending groove and which is provided with fins.

The X-ray generator according to the second embodiment permits the heat transferring effect to be enhanced by convective effect of the gas flown into the second space between the rotary fins and the fixed fins. The second vacuum pump operates to draw the gas from the second space and maintain the second space in a soft vacuum. The first vacuum pump operates to maintain the first space between the cathode and the anode in a high vacuum, thereby increasing the efficiency of X-ray generation.

The present invention will become more fully apparent from the claims and description as it proceeds in connection with the drawings.

DETAILED DESCRIPTION OF PREFERRED EMBODIMENTS

Figure 1:
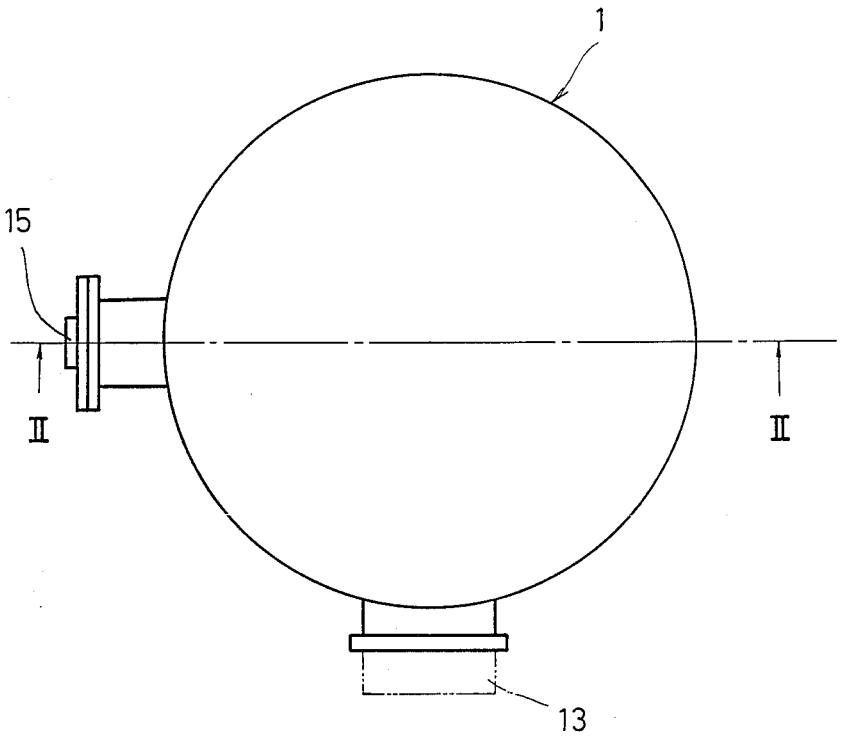
FIG. 1 is a plan view of a cylinder-type X-ray generator according to a first embodiment of the present invention.
Figure 2:
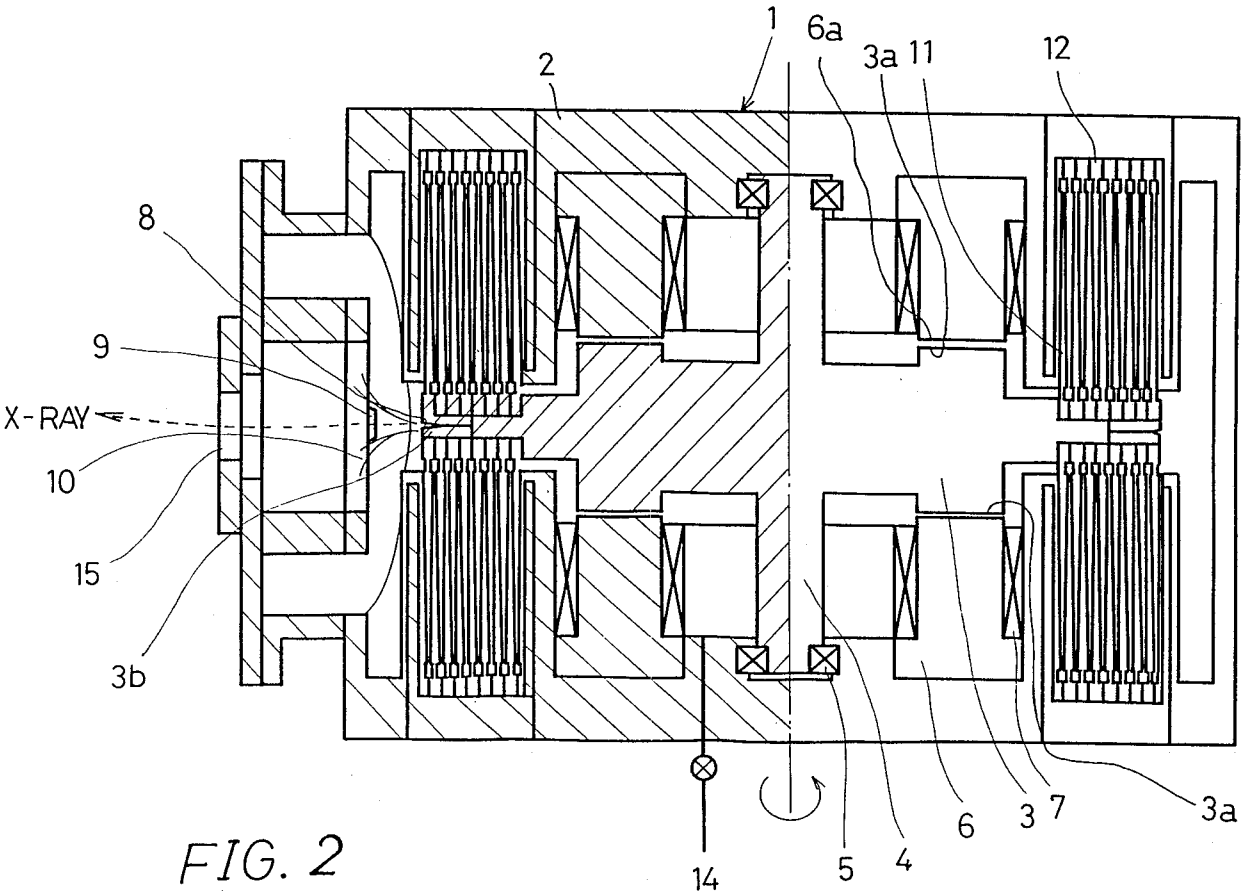
FIG. 2 is a sectional view taken along line II—II of FIG. 1.
Figure 3:
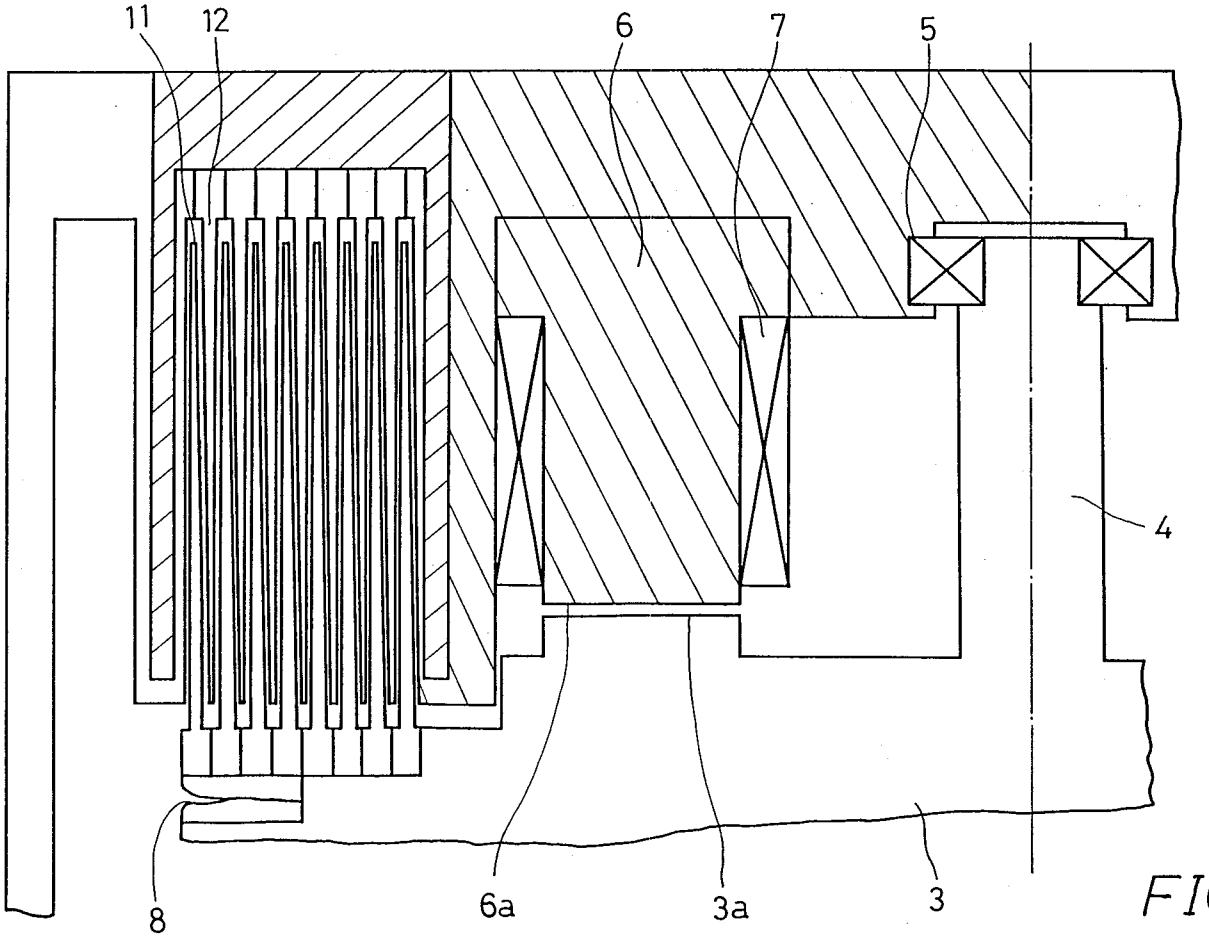
FIG. 3 is an enlarged fragmentary view of FIG. 2.

Referring now to FIGS. 1 to 3, shown therein is a cylinder-type X-ray generator according to a first embodiment of the present invention. As shown therein, the cylinder-type X-ray generator includes a vacuum vessel 1 having a fixed structure 2 and a rotary drum 3. The rotary drum 3 is mounted within the fixed structure 2 and is supported rotatably around a rotary shaft 4 through bearings 5 secured to the fixed structure 2. The fixed structure 2 is provided with stators 6 constituting an electric motor on which coils 7 are wound, so that, when desired alternating current is fed to the coils 7, rotating magnetic fields may be produced. The alternating current flow to the coils 7 causes the rotating magnetic fields to be produced from pole faces **6*a* of the stators 6 in the direction corresponding to the alternating current flow. The rotary drum 3 has pole faces 3*a* formed of permanent magnets in opposed relation to the pole faces 6*a* of the stators 6. The rotating magnetic fields produced from the pole faces 6*a* of the stators 6 by the flow of alternating current to the coils 7 exert repulsive or attractive action to the pole faces 3*a* of the rotary drum 3, causing the rotary drum 3 to rotate around the rotary shaft 4**.

The outer periphery of the rotary drum 3 is formed of, for example, copper to constitute an anode **3*b*. The outer periphery of the rotary drum 3 has at the central portion thereof a V-shaped groove 8 extending therearound. A cathode 9 is provided at a predetermined position in opposed relation to the V-shaped groove 8 and is composed of, for example, a ripeller electrode for emitting an electron beam 10 toward the V-shaped groove 8. The electron beam 10 emitted from the cathode 9 toward the V-shaped groove 8 is so controlled as to be focused on a point of the V-shaped groove 8** by deflecting means (not shown).

The rotary drum 3 is provided with a plurality of rotary fins 11 such as of copper formed into cylindrical configuration. The rotary fins 11 are disposed concentrically around the rotary shaft 4 and are secured to the upper and lower end faces of the rotary drum 3 as viewed in FIG. 2. A plurality of concentric fixed fins 12 are provided being formed into cylindrical configuration similar to the rotary fins 11. The fixed fins 12 extend into spaces each defined between any two adjacent rotary fins 11 in opposed relation thereto and are secured at the proximal ends thereof to the upper and lower inner surfaces of the fixed structure 2. Thus constructed, when the rotary drum 3 is rotated, the rotary fins 11 secured to the upper and lower end faces of the rotary drum 3 are rotated in the spaces each defined between any two adjacent fixed fins 12.

A high vacuum is required in the area between the cathode 9 and the V-shaped groove 8 to generate X-rays by directing the electron beam 10 from the cathode 9 against the V-shaped groove 8 of the rotary drum 3. To this end, a vacuum pump 13 is provided for holding a high vacuum of about $10^{-6}$ torr, as shown in FIG. 1. On the other hand, the rotary fins 11, the fixed fins 12 and the bearings 5 are held in a low vacuum of about $10^{-1}$ torr by supplying appropriate gas flow through a gas inlet port 14. Such a low vacuum is required to protect the bearings 5.

With this arrangement, when the electron beam 10 from the cathode 9 collides against the V-shaped groove 8 of the rotary drum 3, with the latter being rotated by alternating current supplied from an external source to the coils 7, a beam of X-ray is generated and radiated outside through an X-ray radiation window 15 in the form of a flange secured to the left end portion of the vacuum vessel 1, as shown in FIG. 2. The heat generated in the groove 8 when X-rays are radiated is conducted from the rotary drum 3 to the rotary fins 11, from which it is transferred to the respective opposite fixed fins 12 by radiation and convection of the gas. The heat transferred to the fixed fins 12 is further conducted therefrom to the vacuum vessel 1, from which it is in turn dissipated outside by water cooling means (not shown).

From the foregoing detailed description, it can be appreciated that the X-ray generator of the first embodiment may prevent thermal distortion of the anode and ensure stable generation of intensive X-ray, as the heat generated at the anode during generation of X-ray may be transferred by radiation through the rotary fins to the fixed fins.

Figure 4:
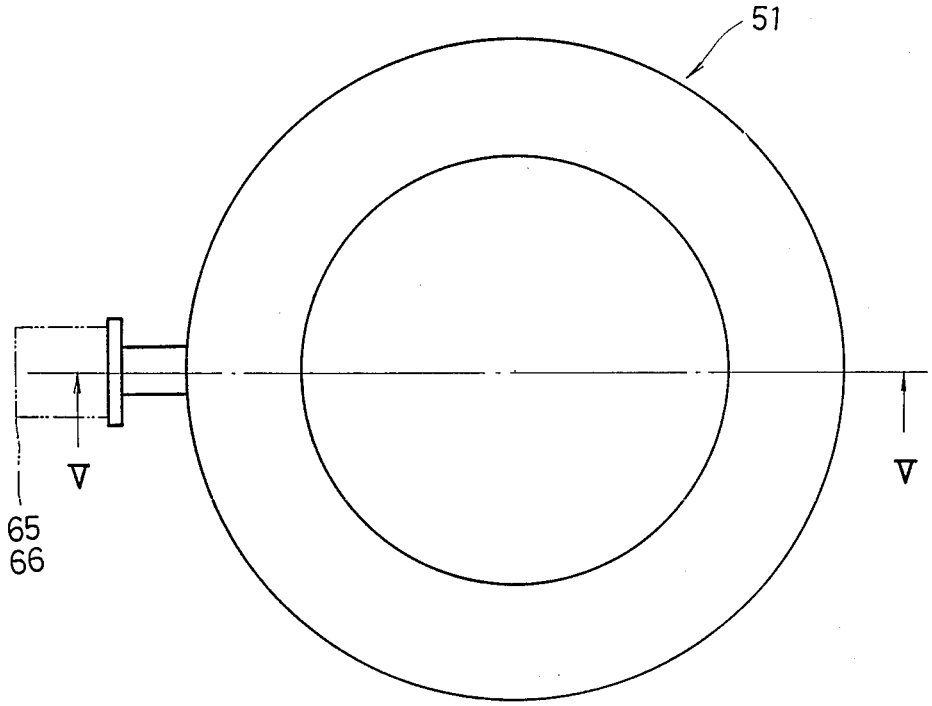
FIG. 4 is a plan view of a disk-type X-ray generator according to a second embodiment of the present invention.
Figure 5:
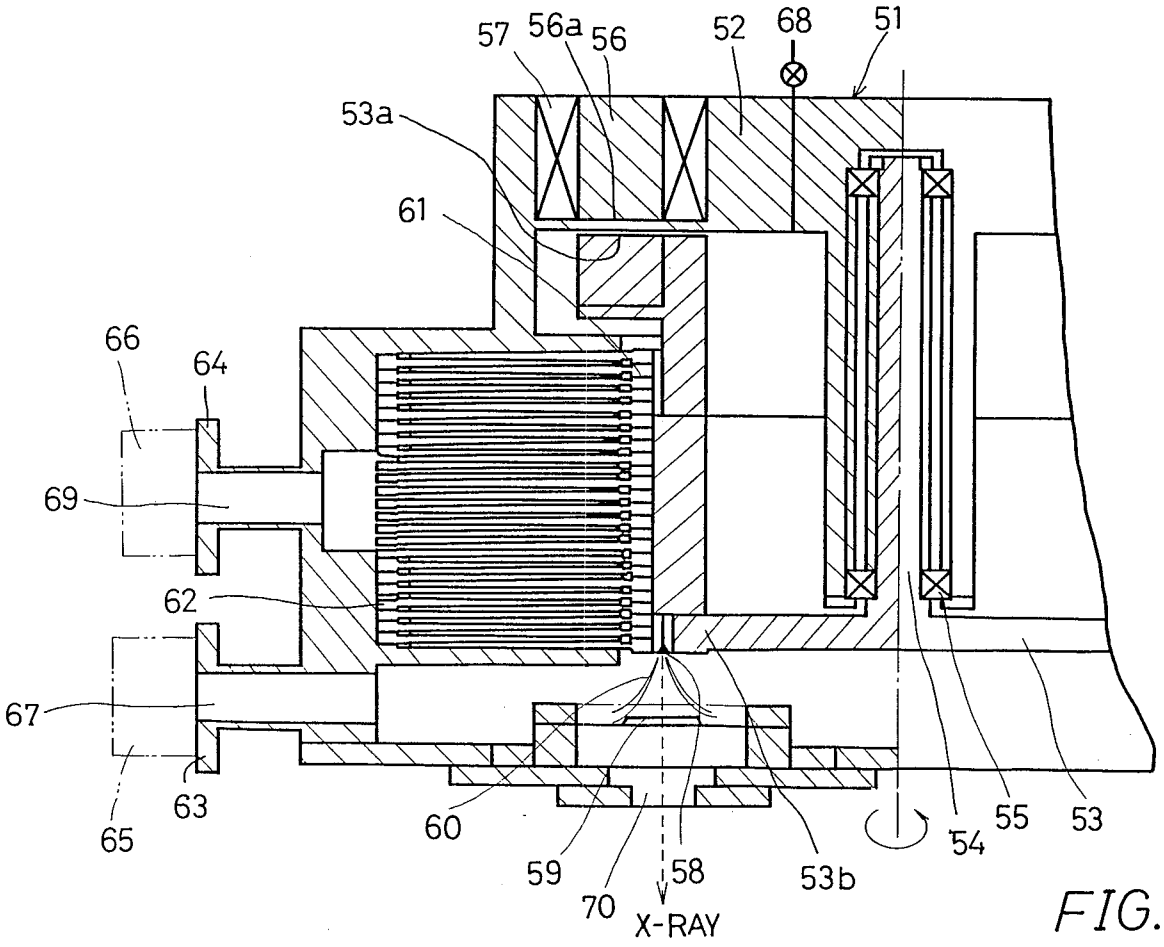
FIG. 5 is a fragmentary sectional view taken along line V—V of FIG. 4.
Figure 6:
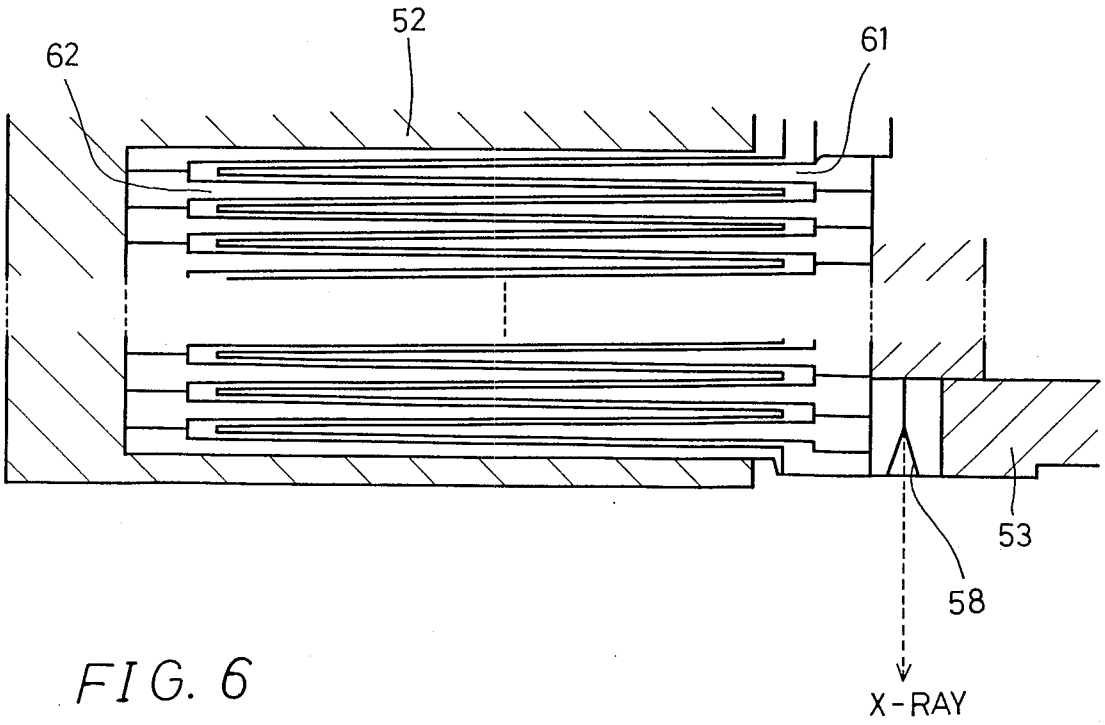
FIG. 6 is an enlarged fragmentary view of FIG. 5.
Figure 7:
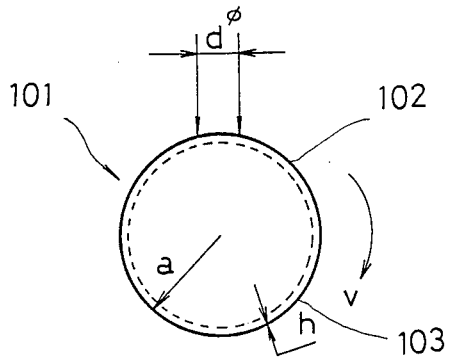
FIG. 7 is a schematic plan view of a grooved rotary anode, illustrating the basic concept of the present invention.
Figure 8:
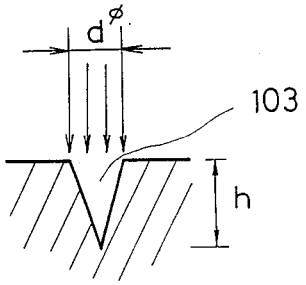
FIG. 8 is a fragmentary detail view of FIG. 7.
Figure 9:
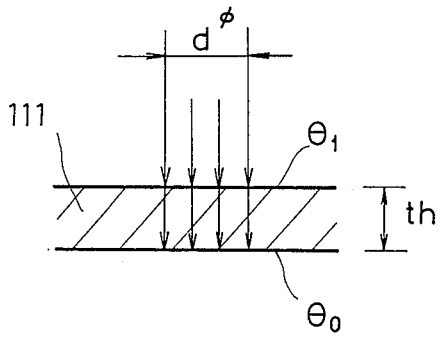
FIG. 9 is a schematic vew of a non-rotary plane anode.
Figure 10:
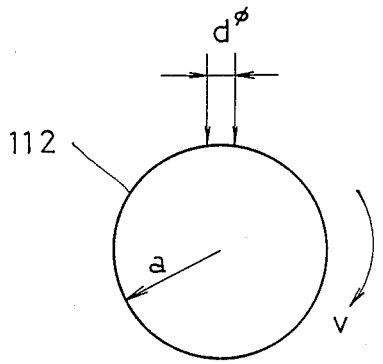
FIG. 10 is a schematic view of a non-grooved rotary anode.

Attention is now directed to FIGS. 4 to 6 which illustrate a disk-type X-ray generator according to a second embodiment of the present invention. As shown therein, the disk-type X-ray generator includes a vacuum vessel 51 having a fixed structure 52 and a rotary drum 53. The rotary drum 53 is mounted wtihin the fixed structure 52 and is supported rotatably around a rotary shaft 54 through bearings 55 secured to the fixed structure 52. The fixed structure 52 is provided with stators 56 constituting an electric motor on which coils 57 are wound, so that, when desired alternating current is fed to the coils 57, rotating magnetic fields may be produced. The alternating current flow to the coils 57 causes the rotating magnetic fields to be produced from pole faces **56*a* of the stators 56 in the direction corresponding to the alternating current flow. The rotary drum 53 has pole faces 53*a* formed of permanent magnets in opposed relation to the pole faces 56*a* of the stators 56. The rotating magnetic fields produced from the pole faces 56*a* of the stators 56 by the flow of alternating current to the coils 57 exert repulsive or attractive action to the pole faces 53*a* of the rotary drum 53, causing the rotary drum 53** to rotate.

In FIG. 5, the rotary drum 53 has a lower end portion and a peripheral portion formed such as of copper, and the lower end portion constitutes a disk-shaped anode **53*b*. The anode 53*b* has a V-shaped groove 58 formed in the underside and extending along the periphery thereof. A cathode 59 is provided at a predetermined position in opposed relation to the V-shaped groove 58 and is adapted to emit an electron beam 60 toward the V-shaped groove 58. The electron beam 60 emitted from the cathode 59 toward the V-shaped groove 58 is so controlled as to be focused on a point of the V-shaped groove 58** by deflecting means (not shown).

A plurality of disk-shaped rotary fins 61 are secured to the outer peripheral surface of the rotary drum 53, stacked at appropriate intervals and extending at right angles to the outer peripheral surface of the rotary drum 53. A plurality of disk-shaped fixed fins 62 are provided and are secured to the inner peripheral surface of the fixed structure 52 opposite to the outer peripheral surface of the rotary drum 53 to which the rotary fins 61 are secured. The respective fixed fins 62 are stacked alternately with the opposite rotary fins 61 in a slightly spaced relation, so that heat from the respective rotary fins 61 can be transferred by radiation to the opposite fixed fins 62, as is the case in the first embodiment.

The vacuum vessel 51 is provided on the outer surface thereof with a pair of flanges 63 and 64 for mounting a first vacuum pump 65 and a second vacuum pump 66, respectively. The first vacuum pump 65 communicates with a space defined between the cathode 59 and the anode **53*b* through a first exhaust port 67 formed in the outer surface of the vacuum vessel 51, and serves to produce a high vacuum in the space. The vacuum vessel 51 also has at the upper portion thereof a gas inlet port 68 through which gas is introduced at a low speed, so that the area including the bearings 55 and the rotary shaft 54 may be held in a soft vacuum for protection of the bearings 55. In addition, the spaces each defined between any one of the rotary fins 61 and adjacent one of the fixed fins 62 are held in a soft vacuum so as to enhance heat transfer by convection of gas through the fins 61 and 62. The second vacuum pump 66 communicates with the spaces about the bearings 55 and the spaces between the fins 61 and 62 through a second exhaust port 69 formed in the outer surfaces of the vacuum vessel 51, and serves to exhaust the gas at predetermined flow rate in response to inflow of the gas so as to hold the spaces about the bearings 55 and the spaces between the fins 61 and 62** in the soft vacuum.

The X-ray generated by collision of the electron beam 60 against the V-shaped groove 58 is radiated to the outside through an X-ray radiation window 70.

With this arrangement, when the electron beam 60 emitted from the cathode 59 collides against the V-shaped groove 58 of the rotary drum 53, with the latter being rotated by alternating current supplied from an external source to the coils 57, a beam of X-ray is generated. The heat generated in the V-shaped groove 58 when X-ray is radiated is directly conducted therefrom to the rotary fins 61, and then it is conducted from the respective surfaces of the rotary fins 61 to the opposite fixed fins 62.

When the heat due to generation of X-ray is transferred from the respective surfaces of the rotary fins 61 to the opposite fixed fins 62, the gas introduced through the gas inlet port 68 is convected to enhance the heat transfer effect, and such a heat transfer can be held constant by exhausting the gas at a constant flow rate. The heat transferred to the fixed fins 62 is then conducted to the vacuum vessel 51, from which the heat is dissipated to the outside by water cooling means (not shown).

From the foregoing detailed description, it can be appreciated that the X-ray generator of the second embodiment may restrain undue increase of the anode temperature, thereby preventing thermal distortion of the anode, and ensures stable generation of intensive X-rays.

Although the groove of the rotary anode is of V-shaped configuration in cross section in the above first and second embodiments, it may be of U-shaped or any other similar configuration. Further, as will be apparent to those skilled in the art, various changes and modifications may be made without departing from the spirit of the present invention which is defined by the appended claims.

What is claimed is:

1. An X-ray generator comprising:

a vacuum vessel;

a cathode disposed in said vacuum vessel for emitting an electron beam;

a plurality of stators constituting an electric motor and disposed within said vacuum vessel for generating rotating magnetic fields;

a disk-shaped anode rotatable about a vertical axis upon reception of the rotating magnetic fields generated from said stators and operable to radiate an X-ray upon reception of the electron beam emitted from said cathode, said disk-shaped anode having a groove formed in the underside along the periphery thereof where the electron beam from said cathode is focused;

a plurality of rotary fins mounted on said disk-shaped anode for dissipating the heat generated in the groove upon radiation of an X-ray;

a plurality of fixed fins mounted within said vacuum vessel in opposed relation to said rotary fins and operable to receive the heat transferred from said rotary fins and dissipate the heat to the outside of said vacuum vessel;

first exhaust port means communicating with a first space defined between said cathode and said anode;

second exhaust port means communicating with a second space defined between said rotary fins and said fixed fins;

gas inlet port means for introducing gas into said second space at a predetermined flow rate;

a first vacuum pump mounted on said first exhaust port means for producing a high vacuum in said first space; and a second vacuum pump mounted on said second exhaust port means for producing a soft vacuum in said second space in response to the flow rate of gas flown into said second space.

2. The X-ray generator as defined in claim 1 wherein said groove of said disk-shaped anode is of V-shaped configuration in cross section.

3. The X-ray generator as defined in claim 1, wherein said disk-shaped anode radiates X-rays vertically downwardly from a point where the electron beam from said cathode is focused.

* * * * *